US005401904A

United States Patent [19]

Greenier, Jr.

[11] Patent Number: 5,401,904

[45] Date of Patent: Mar. 28, 1995

[54] COVER ASSEMBLY FOR A WALL MOUNTED PUSHBUTTON CONTROL UNIT

[76] Inventor: William A. Greenier, Jr., 6 Cutts Rd., Site 028, Kittery, Me. 03904

[21] Appl. No.: 935,279

[22] Filed: Aug. 26, 1992

[51] Int. Cl.[6] ..... H01H 13/04

[52] U.S. Cl. ..... 174/67; 200/43.18; 200/333

[58] Field of Search ..... 174/67; 220/242; 439/135, 136, 142; 200/333, 334, 43.18, 43.19, 43.22

[56] References Cited

U.S. PATENT DOCUMENTS 3,096,409 7/1963 Hubbell et al. ..... 220/43.22
4,451,101 5/1984 Davis ..... 174/67 X
4,604,605 8/1986 Meyers et al. ..... 200/333 X
4,607,900 8/1986 Andrews ..... 220/43.22
4,979,634 12/1990 Begley ..... 174/67

*Primary Examiner*—Leo P. Picard
*Assistant Examiner*—D. A. Tone
*Attorney, Agent, or Firm*—Frederick R. Cantor

[57] ABSTRACT

A cover assembly, for a wall-mounted pushbutton control unit, which normally overlies an array of pushbuttons, and is designed to prevent deliberate, or accidental, actuation of the pushbuttons, is described. The cover assembly, includes a wall plate, attachable to a room wall in surrounding relation to the pushbuttons, and a cover plate, hingedly connected to an upper edge of the wall plate, so that the cover plate, is manually swingable between a closed position, concealing the pushbuttons, and an open position, extending upwardly along the room wall surface.

3 Claims, 2 Drawing Sheets

COVER ASSEMBLY FOR A WALL MOUNTED PUSHBUTTON CONTROL UNIT

BACKGROUND OF THE PRESENT INVENTION

The present invention, relates to wall-mounted pushbutton control units.

The present invention, more particularly relates to pushbutton control units for household security systems.

The present invention, most particularly relates to a cover assembly that can be used to prevent accidental, or deliberate, activation of the pushbuttons of a wall mounted pushbutton household security system control unit.

Household security systems sometimes include control panels, which are mounted on a room wall, and containing an array of pushbuttons for setting the alarm devices, etc. The householder manually depresses selected pushbuttons in a pre-determined order to set the alarm, or to deactivate the alarm. Typically, the control unit pushbuttons project outwardly from the room wall surface.

Since the pushbuttons are exposed, there is always a potential danger that a person might deliberately, or accidently, operate one or more of the pushbuttons in a random fashion, such that the alarm would be either activated, or deactivated, against the desires of the householder. The present invention, is especially designed to provide a cover assembly that can be added to existing wall-mounted pushbutton control units, in order to deter accidental, or inadvertent, operation of the pushbuttons.

It is already known to locate circuit breaker pushbuttons within wall-mounted cabinets for the express purpose of shielding the pushbuttons from contaminating dust or liquids. Such cabinets are relatively expensive. The present invention seeks to provide a less expensive alternative to a complete cabinet. The present invention is also aimed at providing a cover assembly that can be added to existing wall-mounted pushbutton control units, without modifying the existing control units.

SUMMARY OF THE PRESENT INVENTION

An object of the present invention is to provide a cover assembly for a wall-mounted pushbutton control unit.

Another object of the present invention is, particularly, to provide a cover assembly for household security systems.

A further object of the present invention is to provide a cover assembly that can be used to prevent accidental actuation of the pushbuttons of a wall-mounted pushbutton control unit.

The present invention, comprises a cover assembly for a wall-mounted pushbutton control unit, wherein the cover assembly includes a wall plate, adapted to be mounted on the room wall surface, in surrounding relation to the pushbuttons. The pushbuttons extend through the plane of the wall plate, so that the user can exert finger pressure on the individual buttons. A cover plate is hingedly connected to the upper edge of the wall plate, such that the cover plate can be swung between a closed position, extending in front of the pushbuttons, and an open position, extending upwardly along the room wall surface. The cover plate, or wall plate, has side edges that are flanged, to form abutments for limiting movement of the cover plate toward the wall plate, whereby the cover plate is spaced away from the pushbuttons. When the cover plate is in its closed position, it conceals the pushbuttons from view. In this closed position, the pushbuttons cannot be activated, either deliberately or accidently.

A BRIEF DESCRIPTION OF THE DRAWINGS

DESCRIPTION OF THE PREFERRED EMBODIMENTS OF THE PRESENT INVENTION

Figure 1:
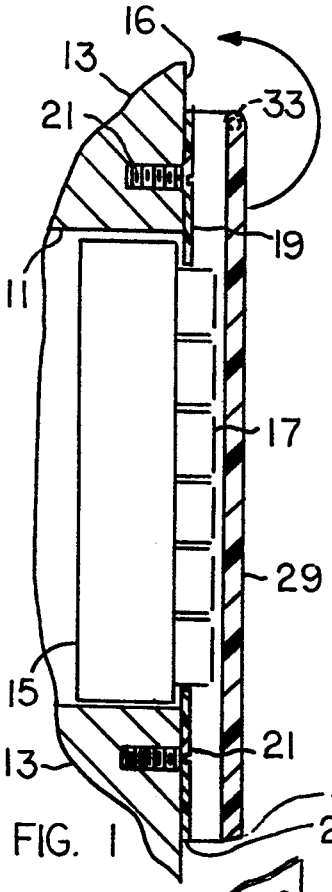
FIG. 1, is a sectional view, taken through a cover plate assembly, constructed according to the present invention.
Figure 2:
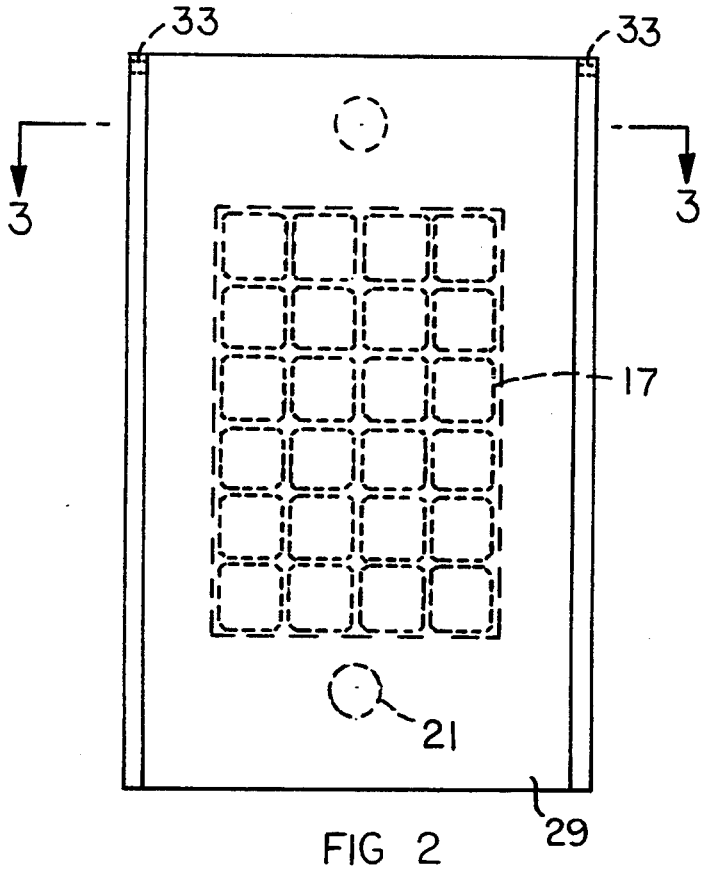
FIG. 2, is a front elevational view, of the FIG. 1 cover assembly.

FIG. 1, illustrates some features of a conventional wall-mounted pushbutton control unit that is suitable for use with the cover assembly of the present invention. A cavity 11 in the room wall 13 houses an electrical chassis 15, that has an array of manual pushbuttons 17 projecting forwardly through a room wall opening. As shown in FIGS. 1 and 2, there are twenty-four pushbuttons arranged in four vertical rows, with six buttons in each row. The pushbutton control unit can have any desired number of pushbuttons, suited to the end purposes of the particular control unit. One such use of the control unit is designed to control a household security alarm system.

In the illustrated control unit, as seen in FIG. 1, the pushbuttons 17 project forwardly through the opening in room wall 13, so that the button front surfaces are beyond the wall surface 16. The control unit, as conventionally constructed, includes a flat face plate having an opening, or cut-out, mated to the outline of the pushbutton assembly, such that when the face plate is installed against wall surface 16, the cavity is concealed from view. The face plate provides a border around the pushbutton assembly, so that the pushbutton control unit presents an attractive finished appearance.

In practicing the present invention, the conventional ornamental face plate is discarded, i.e., removed. In its place a special wall plate 19, is secured to room wall surface 16, using the same screws 21, that would normally be used to mount the conventional face plate (not shown).

Wall plate 19, has a rectangular cut-out, sized to accommodate the array of forwardly projecting pushbuttons. Two screw holes are formed in the wall plate 19, to receive the mounting screws 21. Along its side edges, wall plate 19 has two forwardly projecting side walls 23. The upper and lower edges of wall plate 19 are devoid of flanges or other projections. As viewed in FIG. 3, wall plate 19 has a channel cross-section.

Figure 4:
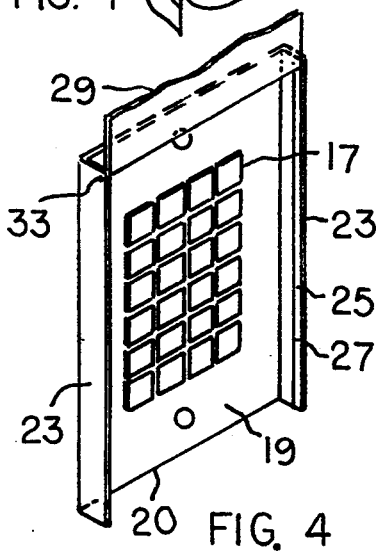
FIG. 4, is a fragmentary perspective view, of the FIG. 1 cover assembly, taken on a reduced scale, and with the cover plate in an open position.
Figure 3:
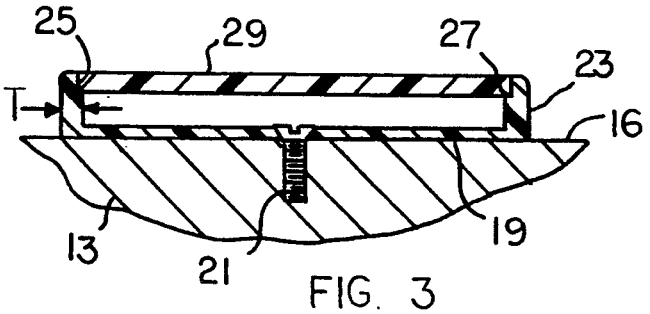
FIG. 3, is a sectional view, taken along line 3—3, in FIG. 2.

Side walls, or flanges 23, on wall plate 19 can be rabbeted, as at 25, to form internal shoulders 27. FIG. 3 shows the shoulder 27 cross-sectional configuration. FIG. 4 illustrates how the shoulders 27 extend along the entire length of each associated side wall 23. A hinged cover plate 29 is connected to the upper edge of wall plate 19, so that the side edge areas of the cover plate 29 normally abut against shoulders 27, as shown in FIG. 3.

As shown by the curved arrow in FIG. 1, the hinged cover plate 29 can be swung upwardly from its FIG. 1 position to a raised position resting against the room wall surface 16. The swinging motion is slightly more than one-hundred and eighty (180) degrees, such that the cover plate 29 is then in a stable position when it is raised, or swung upwardly, to a position engaged against room wall surface 16. FIG. 4, shows the fragmentary cover plate 29, swung upwardly to its so-called "open" position. FIG. 1, shows the cover plate 29 swung down to its so-called "closed" position.

With the cover plate 29 in its closed position, its side edges abut against shoulders 27. The cover plate 29, in its closed position, is firmly positioned, and spaced, a slight distance away from the pushbuttons, e.g., about one-sixteenth of an inch, in a typical construction. In the closed position of the cover plate 29 its lower edge 31 is spaced away from the lower edge 20 of wall plate 19, whereby a person can use edge 31 as a handle to swing the cover plate 29, upwardly to its open position.

Figure 5:
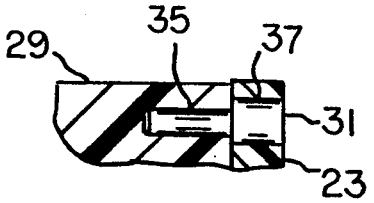
FIG. 5, is a fragmentary sectional view, illustrating a hinge pin construction, that can be used in the FIG. 1 cover plate assembly.

The hinge mechanism for cover plate 29 comprises two aligned hinge pins 33 extending from the side edges of plate 29 into circular holes in side walls 23 of the wall plate 19. FIG. 5, shows a hinge pin construction that can be used. As there shown, the hinge pin includes a small diameter pin section 35 having a press fit into a small hole in the edge of cover plate 29, and a large diameter section 37 extending freely within a circular hole in side wall 23. The hinge pin 33 can be installed on cover plate 29 after the cover plate 29 is seated against shoulders 25, e.g., by inserting the hinge pins through the holes in side walls 23. After installation of the hinge pins 33, cover plate 29 is freely swingable around the hinge pin axis.

Cover plate 29, will typically be formed out of a rigid plastic material, preferably transparent, with a transverse thickness of about one-eighth of an inch. Small diameter section 35 of each hinge pin 33 can have a diameter of about 0.07 of an inch, whereas the large diameter section 37 of each hinge pin 33 can have a diameter of about 0.12 of an inch. The hinge pins 33, will preferably be formed of a wear-resistant plastic material, e.g., nylon. The wall plate side walls, or flanges 23, will preferably have a transverse thickness dimension T, see FIG. 3, of about one-eighth of an inch, in order to provide reasonably straight, i.e., linear, joints with the side edges of the cover plate 29. Thickness dimension T, is sufficient to provide reasonably sized bearing surfaces for the hinge pins 33.

When the cover assembly is installed on room wall surface 16, the assembly has a desired rigidity, even though the plastic wall sections are of relatively light gauge construction. Side walls 23 reinforce the relatively thin wall plate 19, to provide two straight, flat shoulder surfaces 27 for seating cover plate 29 in its closed position. Hinge pins 33 are widely spaced, so that cover plate 29 is precluded from wobbling while it is being moved between its open and closed positions. The user is thus assured that the cover assembly will withstand the stresses of reasonably rough usage, over a relatively long period of useful service.

Figure 6:
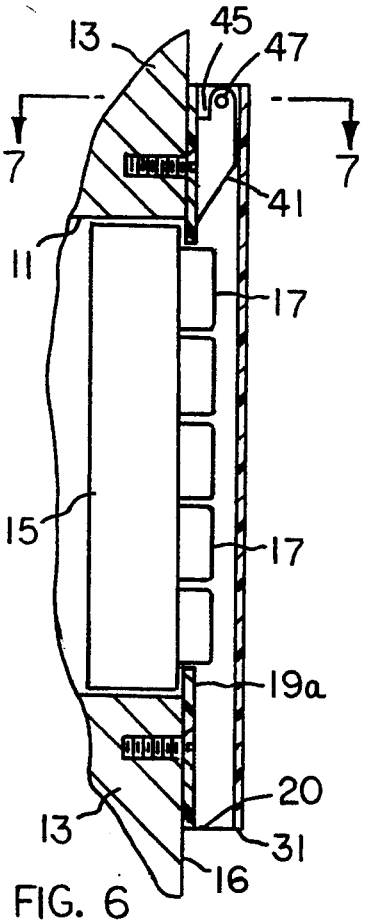
FIG. 6, is a sectional view, taken in the same direction as FIG. 1, but illustrating another embodiment of the present invention.
Figure 7:
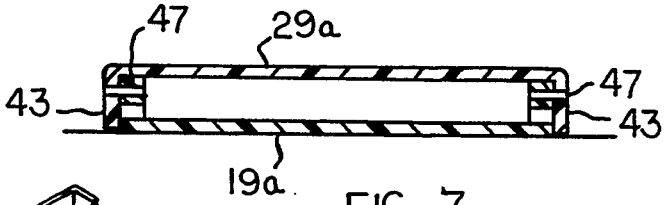
FIG. 7, is a transverse sectional view, taken along line 7—7, in FIG. 6.
Figure 8:
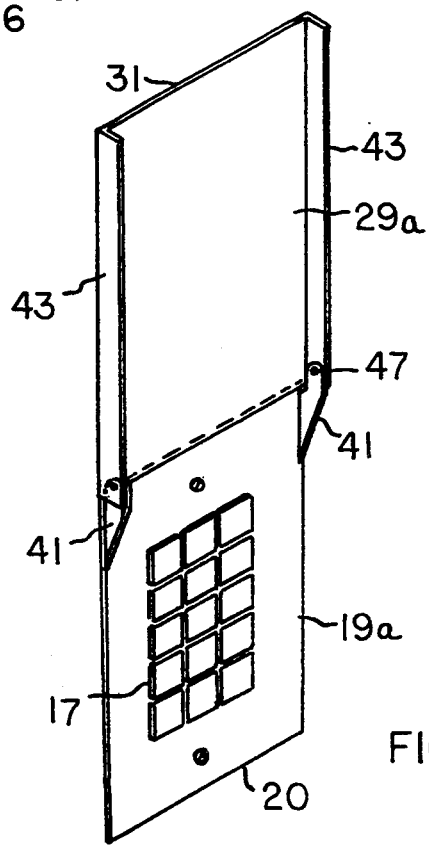
FIG. 8, is a perspective view, of the FIG. 6 cover plate assembly, taken on a reduced scale. The cover plate is shown in an open position.

FIGS. 6, 7, and 8, illustrate another embodiment, or form, that the present invention can take. In this case, the wall plate is a relatively thin flat plate **19*a*, formed of a plastic material, and having two integral ears 41 extending right-angularly from the wall plate 19 front surface. The cover plate 29*a* comprises a relatively thin flat plate, having two in-turned flanges 43 extending along its side edges. As viewed in FIG. 7, the cover plate 29*a* has a channel cross section. The wall plate 19*a*, and the flanged cover plate 29*a***, are each, preferably, formed of a rigid plastic material.

Two circular hinge pins 47 extend from flanges 43 into circular holes in ears 41, to form a hinged connection between the cover plate **29*a* and the wall plate 19*a*. Additionally, each hinge pin 47, can have a glued tight fit in the associated flange wall 43. An undercut 45, may be formed in each ear 41, in order to permit the cover plate 29*a* to swing a full one hundred and eighty (180) degrees, when it is moved to its open position, as shown in FIG. 8. Each ear 41, preferably, has an increased transverse thickness, as viewed in FIG. 7, to provide sufficient bearing area for the associated hinge pin 47. Lower edge 31 of the cover plate 29*a* is spaced away from the lower edge 20 of the wall plate 19*a* when the cover plate 29*a* is in its closed position. Edge 31** can thus be used as a handle for swinging the cover plate upward, to its open position.

The present invention relates to improvements for wall-mounted pushbutton control units for household security systems. Features of the present invention are recited in the appended claims. The drawings contained herein necessarily illustrate specific embodiments of the apparatus, useful in the practice of the present invention. However, it will also be appreciated by those skilled in the arts pertaining thereto, that the present invention can be practiced in various forms and configurations. Further, the previous detailed descriptions of the preferred embodiments of the present invention, are presented for the purposes of clarity of understanding only, and no unnecessary limitations, should be understood or implied therefrom. Finally, all appropriate mechanical and functional equivalents to the above, which may also be obvious to those skilled in the arts pertaining thereto, are considered to be encompassed within the claims of the present invention.

What is claimed is:

1. In a room wall-mounted pushbutton control unit, wherein an array of pushbuttons project through a wall opening and beyond and associated room wall surface, the combination comprising:

a cover assembly for protecting said pushbuttons from inadvertent actuation;

said cover assembly comprising a wall plate, a cover plate, and hinge means swingably mounting said cover plate on said wall plate;

said wall plate having a lower edge, two side edges, and an upper edge; said wall plate having a cut out sized to accommodate the pushbuttons and at least two screw holes, whereby said wall plate can be mounted flatwise on a room wall surface with the pushbuttons extending through the cut out;

said cover plate having a lower edge, two side edges, and an upper edge; said cover plate having two side walls extending along its side edges from its upper edge to its lower edge, whereby said cover plate has a channel cross section; said side walls constituting a spacer means for spacing said cover plate away from said wall plate when said cover plate is in a closed position extending in front of the push-buttons;

said hinge means comprising two spaced ears extending right angularly from said wall plate at its upper edge, and two aligned hinge pins extending from the cover plate side walls into circular openings in said ears, whereby said cover plate can be swung upwardly from its closed position to an open position extending upwardly along the room wall surface.

2. The combination of claim 1, wherein each plate is formed out of a plastic material.

3. The combination of claim 2, wherein said lower edge of said cover plate is spaced away from said lower edge of said wall plate when said cover plate is in its closed position, whereby said lower edge of said cover plate serves as a handle for moving said cover plate to its open position.

* * * * *